United States Patent [19]

Nutt

[11] 4,084,143

[45] Apr. 11, 1978

[54] TRANSFORMER MOUNTING ASSEMBLY

[75] Inventor: A. D. Nutt, Little Rock, Ark.

[73] Assignee: Duncan Electric Company, Inc., Lafayette, Ind.

[21] Appl. No.: 765,626

[22] Filed: Feb. 4, 1977

[51] Int. Cl.[2] ..... H01F 15/02

[52] U.S. Cl. ..... 336/65; 248/61; 336/68; 403/346; 403/400

[58] Field of Search ..... 174/148, 149 R; 248/74 R, 68 R, 61; 24/81 G; 403/400, 346; 336/173, 174, 175, 65, 66, 67, 68

[56] References Cited

U.S. PATENT DOCUMENTS

| | | | |
|---|---|---|---|
| 2,841,772 | 7/1958 | Sloop | 336/67 |
| 2,889,128 | 6/1959 | Martin et al. | 248/61 X |
| 3,487,158 | 12/1969 | Killian | 174/149 R |

FOREIGN PATENT DOCUMENTS

| | | | |
|---|---|---|---|
| 162,634 | 8/1904 | Germany | 174/149 R |

*Primary Examiner*—Thomas J. Kozma
*Attorney, Agent, or Firm*—John R. Nesbitt

[57] ABSTRACT

A transformer mounting assembly is disclosed for mounting a plurality of current transformers on a wire. A pair of parallel mounting plates are positioned normal to one another with one of the mounting plates having first and second current transformers mounted on the same side of the mounting plate at the opposite end portions and the engaging mid portions of the mounting plates having a third current transformer mounted thereat with the third current transformer being at the other side of the mounting plate from that of the first and second current transformers. The opposite end portions of the other mounting plate have clamps mounted thereon with the clamps being contoured to releasably clamp the assembly to a neutral wire with the other mounting plate extending along the wire. The current transformers have central apertures whereby each of three conductors of a three phase electrical power supply can extend through the central apertures of different transformers so that a transformer is thus provided for each phase of the three phase electrical power supply.

6 Claims, 2 Drawing Figures

TRANSFORMER MOUNTING ASSEMBLY

FIELD OF THE INVENTION

This invention relates to a mounting assembly and, more particularly, relates to a wire-mountable transformer mounting assembly.

BACKGROUND OF THE INVENTION

As is well known, electrical energy is commonly carried on conductors, or wires, to the desired point of utilization. It is often necessary, however, to utilize one or more transformers in conjunction with the conductors. With three phase electrical power carried on three separate conductors, three current transformers are needed.

While providing current transformers at a wire and/or providing mounting assemblies for current transformers have heretofore been suggested and/or utilized, complete satisfaction has not heretofore been achieved, at least in some situations. For example, it has been suggested that the mounting feet of current transformers could be bent and bolted to clamp three current transformers around a messenger wire, and it has also been suggested that mounting brackets be utilized for mounting such current transformers but in a manner so as to allow the transformers to hang below the service.

An improved mounting bracket was therefore needed for mounting current transformers onto a neutral wire with the bracket preferably being simple in construction yet dependable in clamping the current transformers about the neutral wire.

SUMMARY OF THE INVENTION

This invention provides an improved mounting assembly for mounting current transformers about a neutral wire.

It is therefore an object of this invention to provide an improved mounting assembly.

It is still another object of this invention to provide an improved mounting assembly for mounting current transformers about a neutral wire.

It is yet another object of this invention to provide an improved mounting assembly that includes a pair of parallel normally positioned plates having current transformers mounted at one side of opposite end portions of one plate and a third current transformer at the other side of the plate at the junction of the mid-portions of the two plates.

It is still another object of this invention to provide an improved mounting assembly that includes a pair of parallel normally positioned plates one of which has clamps at the opposite end portions to clamp the assembly along a wire.

With these and other objects in view, which will become apparent to one skilled in the art as the description proceeds, this invention resides in the novel construction, combination, and arrangement of parts substantially as hereinafter described, and more particularly defined by the appended claims, it being understood that such changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
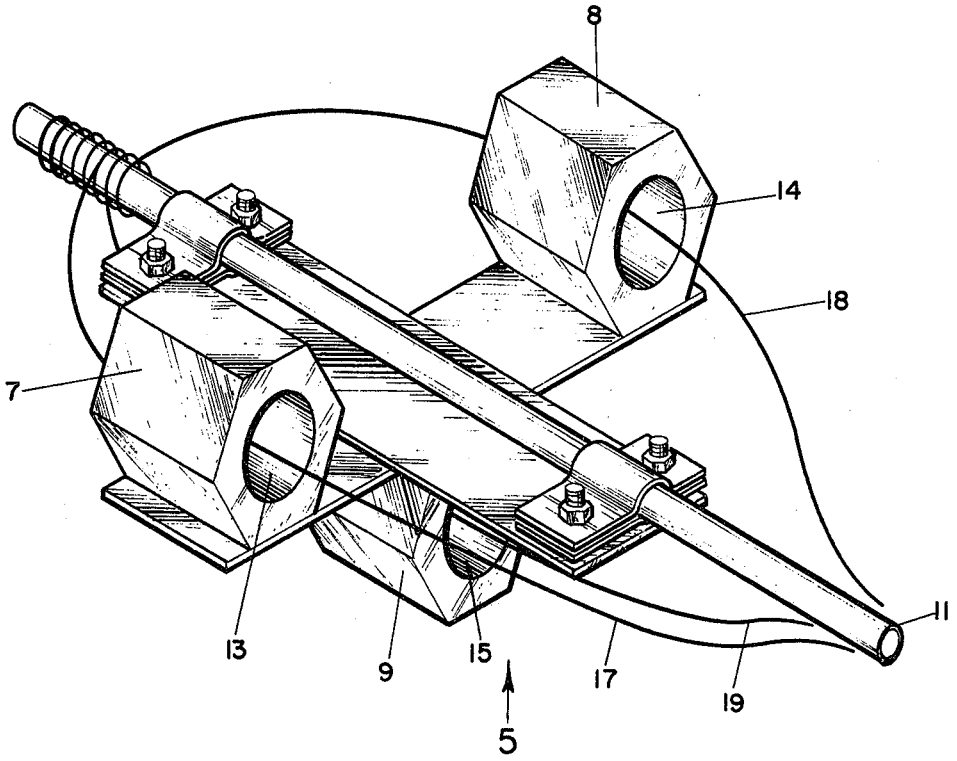
FIG. 1 is a perspective view of the mounting assembly of this invention having current transformers mounted thereon and with the assembly clamped onto a neutral wire.

Referring now to the drawings, the mounting assembly 5 of this invention is shown in FIG. 1 to have current transformers 7,8 and 9 mounted thereon with the mounting assembly being clamped to wire 11. Wire 11 is a neutral wire and can extend, for example, from a conventional power line pole to a junction for a customer's building. The current transformers may be conventional and each has a central aperture (indicated by the numberals 13, 14 and 15).

Electric power is conventionally coupled through conductors, or wires, as is well known, from a generating plant to the point of utilization. Where three phase service is provided, three conductors (indicated by the numerals 17, 18 and 19) are utilized with each carrying one phase, and, of course, single phase service can be derived therefrom.

As shown in FIG. 1, conductor 17 (carrying, for example, phase A of the three phase electrical power) is wrapped around wire 11 on the source side of the mounting assembly 5 and passes through current transformer 7 mounted on the mounting assembly. In like manner, conductor 18 (carrying, for example, phase B of the three phase electrical power) is wrapped around wire 11 on the source side of the mounting assembly and passes through current transformer 8 mounted on the mounting assembly, and conductor 19 (carrying, for example, phase C of the three phase electrical power) is wrapped around wire 11 on the source side of the mounting assembly and passes through current transformer 9 also mounted on the mounting assembly 5.

Figure 2:
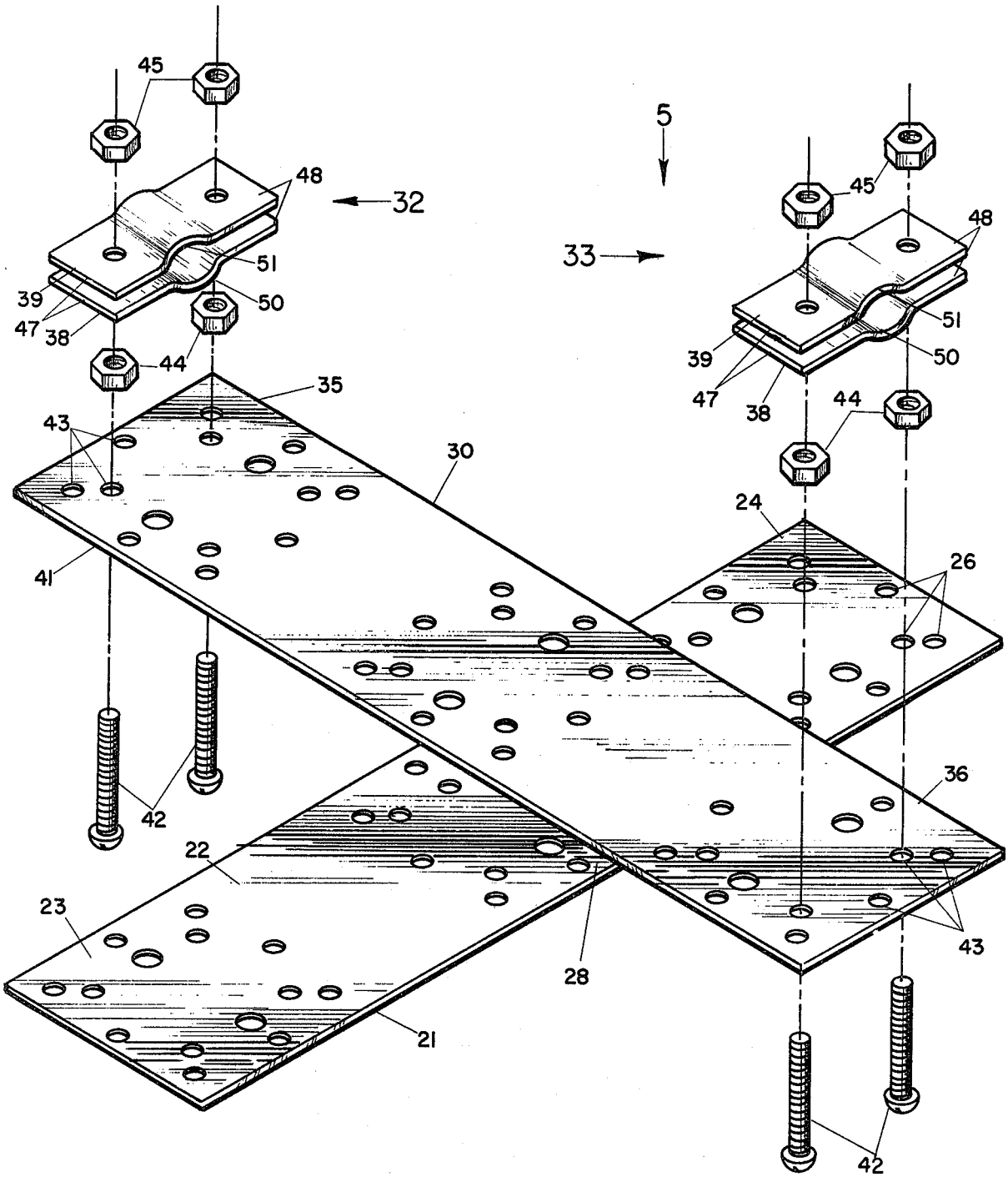
FIG. 2 is an exploded perspective view of the mounting assembly shown in FIG. 1.

The mounting assembly 5 is shown by the exploded perspective view of FIG. 2. As shown, a first flat rectangular plate 21 is provided for mounting current transformers 7 and 8 at one side 22 of the opposite end portions 23 and 24, respectively. The current transformers are not shown in FIG. 2, but it is understood that each transformer can have mounting feet, or straps, thereon that are attached conventionally (as, for example, by both passing through any convenient aperture 26 in the plate, with the bolts being tightened in place by conventional nuts thereon). The third current transformer 9 extends from the side opposite to that of side 22 of plate 21 and is mounted at the mid portion 28 of the plate in the same manner as transformers 7 and 8 are mounted.

A second flat rectangular plate 30 is provided for mounting clamps 32 and 33 at opposite end portions 35 and 36, respectively, of the plate 30. As shown, each of the clamps 32 and 33 include clamping pieces 38 and 39 which are conventionally secured to one side 41 of the plate 30 by bolts 42 (passing through any conventional aperture 43 in plate 30) and nuts 44, with nuts 45 being provided for securing the end portions 47 and 48 of the clamping pieces together to clamp wire 11 therebetween. As shown, the clamping pieces 38 and 39 are contoured by being curved outwardly with respect to one another at the mid-portions 50 and 51, respectively, so as to receive wire 11 therebetween.

Plates 21 and 30 are parallel with respect to one another and positioned normally with respect to one another so that the flat central portion of side 22 of plate 21 engages the flat central portion of side 41 of plate 30. If desired, of course, the opposite sides of the plates could be in engagement, in which case the current transformer 9 would be mounted on the plate 30 rather than on the plate 21. In either case, however, current transformer 9 extends from the plates in the direction opposite to that of the direction that current transformers 7 and 8 extend.

Plates 21 and 30 are preferably metal plates and can be, for example, steel plates having dimensions of about 0.104 × 9.962 × 3 inches.

In operation, the current transformers are mounted on the mounting assembly and each conductor of the three phase electrical power is threaded through a different one of the current transformers. The mounting assembly is mounted on wire 11 (either before or after threading the conductors through the current transformers) and installation is then complete.

As can be seen from the foregoing, this invention provides an improved mounting assembly for mounting current transformers about a wire.

What is claimed is:

1. A transformer mounting assembly, comprising:

a first elongated, rectangularly shaped, flat mounting plate having mounting thereat at flat opposite end portions, a pair of current transformers extending in a first direction from one side of said first mounting plate;

a second elongated, rectangularly shaped, flat mounting plate substantially normally positioned with respect to said first mounting plate with the flat central portion of said first mounting plate engaging one side of the flat central portion of said second mounting plate and having a third current transformer mounted to the flat central portion of the other side of said first mounting plate and extending in the direction opposite to said first direction; and mounting means at the opposite end portions of said second mounting plate for enabling mounting of said second plate along a wire so that said second plate is maintained substantially parallel with respect to such a wire when so mounted.

2. The transformer mounting assembly of claim 1 wherein each of said current transformers has an aperture therethrough, and wherein a three phase cable extends along said wire with said cable having at least three conductors each of which passes through said aperture in a different one of said current transformers.

3. The transformer mounting assembly of claim 1 wherein said mounting means includes a pair of clamps at each end portion of said second mounting plate, the mid portions of each of said clamps being contoured to receive and clamp said wire therebetween.

4. The transformer mounting assembly of claim 3 wherein said mounting means includes securing means whereby each pair of said clamps are adjustably fastened at said one side of the end portions of said second mounting plate.

5. A wire-mounted current transformer assembly, comprising:

a first substantially flat rectangular mounting plate;

first and second current transformers mounted on one side of said first mounting plate at opposite end portions thereof, each of said first and second current transformers having a central aperture therein for receiving different conductors each of which carry a different phase of a three-phase electrical power supply;

a second substantially flat rectangular mounting plate positioned substantially parallel and normal with respect to said first mounting plate with said mounting plates engaging one another at the central portion of each plate;

a third current transformer mounted to said central portions of said mounting plates with said third current transformer being at the side of said first mounting plate opposite to that of said first and second current transformers, said third current transformer having a central aperture therein receiving a third conductor carrying the third phase of said three-phase electrical power supply;

a pair of clamps at each end portion of said second mounting plate; and securing means for connecting said clamps to said end portions of said second mounting plate and for releasably clamping a wire between said clamps so that said second mounting plate extends along said wire.

6. The wire-mounted current transformer assembly of claim 5 wherein said clamps are curved outwardly from one another at the mid-portion so as to receive said wire therebetween, and wherein said securing means engage the end portions of each of said clamps to cause movement of said clamps toward one another to clamp said wire therebetween.

* * * * *